United States Patent [19]

Yoshioka et al.

[11] 4,405,408

[45] Sep. 20, 1983

[54] CELLULOSE PROCESSING AGENTS AND PAPER PROCESSED THEREWITH

[75] Inventors: Shigehiko Yoshioka; Hideto Yamada; Akira Asakura, all of Akashi, Japan

[73] Assignee: Seiko Kagaku Kogyo Co., Ltd., Hyogo, Japan

[21] Appl. No.: 346,056

[22] PCT Filed: Jun. 24, 1980

[86] PCT No.: PCT/JP80/00142

§ 371 Date: Jan. 20, 1982

§ 102(e) Date: Jan. 20, 1982

[87] PCT Pub. No.: WO82/00038

PCT Pub. Date: Jan. 7, 1982

[51] Int. Cl.[3] ..... D06M 13/10; D21H 3/02

[52] U.S. Cl. ..... 162/158; 162/164.3; 162/164.6; 162/168.3; 524/364; 524/607; 524/608; 524/612; 528/332

[58] Field of Search ..... 162/158, 164.3, 164.6, 162/168.3, 179; 528/332; 524/362, 364, 608, 612, 607

[56] References Cited

U.S. PATENT DOCUMENTS

| | | | |
|---|---|---|---|
| 2,518,148 | 8/1950 | Jordan et al. | 528/332 |
| 2,772,969 | 12/1956 | Reynolds, Jr. et al. | 162/179 |
| 3,006,806 | 10/1961 | Schur | 162/158 |
| 4,317,756 | 3/1982 | Dumas | 162/158 |

FOREIGN PATENT DOCUMENTS

| | | | |
|---|---|---|---|
| 598093 | 5/1960 | Canada | 162/179 |
| 2819039 | 11/1979 | Fed. Rep. of Germany | 162/179 |
| 38-3630515 | of 1963 | Japan . | |
| 52-110906 | of 1977 | Japan . | |
| 52-118010 | of 1977 | Japan . | |
| 54-147211 | of 1979 | Japan . | |
| 1388954 | 4/1975 | United Kingdom | 526/608 |

*Primary Examiner*—William F. Smith

*Attorney, Agent, or Firm*—Parkhurst & Oliff

[57] ABSTRACT

A cellulose treating agent obtained by dispersing an alkyl ketene dimer in water in the presence of a dispersing agent comprising a reaction product of a polyalkylenepolyamine and a mixture of carboxylic acids containing at least 20% by weight of aliphatic monohydroxymonocarboxylic acids having 9 to 32 carbon atoms or a product obtained by reacting epihalohydrin with said reaction product. This cellulose treating agent existing as a very stable cationic aqueous dispersion of the alkyl ketene dimer is highly effective to impart a water repellency to cellulose fibers and can be used as a well-improved reactive sizing agent for papermaking.

6 Claims, No Drawings

CELLULOSE PROCESSING AGENTS AND PAPER PROCESSED THEREWITH

FIELD OF THE ART

The present invention relates to a cellulose treating agent which is obtained by dispersing an alkyl keten dimer in water in the presence of a dispersing agent which comprises a reaction product of a mixture of selected carboxylic acids and polyalkylenepolyamine such as triethylenetetramine or a product obtained by reacting an epihalohydrin with said reaction product and, more specifically, to such a cellulose treating agent of the aforementioned type that is most suitably applicable as a water repellent for paper and other cellulosic product and, particularly, as a reactive sizing agent for papermaking.

BACKGROUND OF THE INVENTION

It is well-known that alkyl ketene dimers are bonded with hydroxyl groups of cellulose molecules generally to impart thereto a water repellency. Because of such properties, alkyl ketene dimers are commonly used as cellulose treating agents to impart a water repellency to paper and other cellulosic products and, especially, as reactive sizing agents for papermaking. Typical examples of alkyl ketene dimers used for such applications include decyl ketene dimer, dodecyl ketene dimer, tetradecyl ketene dimer, hexadecyl ketene dimer, octadecyl ketene dimer and the like.

Since alkyl ketene dimers are water-insoluble, they are dispersed in water by various methods for permitting them to be used as cellulose treating agents. In this connection, it is most desirable to use such an alkyl ketene dimer as a cationic dispersion for obtaining a higher effect. This is because if the alkyl ketene dimer is dispersed in water as cationic fine particles, the bonding between the alkyl ketene dimer and cellulose which shows anionic properties in water will be promoted by the attraction between the positive charges of the fine particles of the alkyl ketene dimer and the negative charges of the cellulose. Heretofore, as cationic dispersing agents for alkyl ketene dimers used for the aforementioned purpose, several substances have been proposed including cationic starch (U.S. Pat. No. 3,130,118), polyamidepolyamine-epihalohydrin resins, cationic melamine-formaldehyde resins (U.S. Pat. No. 3,046,186) and cationic urea-formaldehyde resins. However, since dispersions obtained by using these cationic dispersing agents according to the prior art are rather poor in their stability, they cannot fully exhibit an effect as cellulose treating agents.

Accordingly, an object of the present invention is to provide a solution to the foregoing problems or drawbacks of the prior art in applying alkyl ketene dimers as cellulose treating agents.

SUMMARY OF THE INVENTION

The present invention provides improved cellulose treating agents each comprising a stable cationic dispersion of an alkyl ketene dimer. Further, the present invention provides paper which is sized with the aforementioned cellulose treating agents and, particularly, paper which is most effectively sized internally therewith.

As a result of a series of studies, the inventors have found out that a highly stable cationic aqueous dispersion of an alkyl keten dimer can be obtained by dispersing it in water in the presence of a dispersing agent comprising a reaction product of an aliphatic monohydroxymonocarboxylic acid having 9 to 32 carbon atoms and polyalkylenepolyamine and/or a product obtained by reacting an epihalohydrin with said reaction product and that such a dispersion have a superior effect as a cellulose treating agent. The present invention has been achieved on the basis of the aforementioned findings by the inventors.

The reaction between an aliphatic monocarboxylic acid or aliphatic dicarboxylic acid and polyalkylenepolyamine proceeds as a reaction between the primary amino groups of the polyalkylenepolyamine and carboxyl groups of the carboxylic acid to produce an amide, and the reaction is most promoted at temperatures above 100° C. or, preferably, at 150° C. to 250° C., and by removing from the reaction system the water which is a condensation product of the reaction, as is well known. Also, it is well known to use such a reaction product of an aliphatic monocarboxylic acid or aliphatic dicarboxylic acid and a polyalkylenepolyamine or a product obtained by reacting an epihalohydrin with said reaction product as a paper sizing agent (U.S. Pat. No. 2,772,969) or a paper strengthening agent (Japanese Pat. No. 35-3,547). However, even if these prior art sizing agents or paper strengthening agents are used as dispersing agents for producing an aqueous dispersion of an alkyl ketene dimer, the resultant dispersion cannot at all have such a sufficient stability as is achievable in the present invention. That is to say, with the prior art dispersing agents, the aforementioned object of the present invention cannot be achieved. While, if the aliphatic carboxylic acids used as one of the foregoing reactants contain at least about 20% by weight of an aliphatic monohydroxymonocarboxylic acid having 9 to 32 carbon atoms, its reaction product, when used as a dispersing agent, shows a remarkably high effect to stabilize the resultant aqueous dispersion of an alkyl ketene dimer, and this aqueous dispersion exhibits a highly improved effect as a cellulose treating agent. This is really a surprising effect that has been unknown heretofore, although the reason why or the mechanism by which the existance of a monohydroxymonocarboxylic acid in the dispersing agent for an alkyl ketene dimer produces such a peculiar effect remains to be solved by studies in future.

As the aforesaid aliphatic monohydroxymonocarboxylic acid having 9 to 32 carbon atoms according to the present invention, usable are 2-hydroxydodecanoic (or 2-hydroxylauric) acid, 2-hydroxytetradecanoic (or 2-hydroxymyristic) acid, 2-hydroxyhexadecanoic (or 2-hydroxypalmitic) acid, 11-hydroxypentadecanoic acid, 11-hydroxyhexadecanoic (or 11-hydroxypalmitic) acid or 12-hydroxyoctadecanoic (12-hydroxystearic) acid, for example. Also, these aliphatic hydroxymonocarboxylic acids may be used in the form of mixtures containing them such as fatty acids of castor oil and hydroxyfatty acids contained in lanolin.

In the present invention, it is desired that the polyalkylenepolyamine will be mixed with the aliphatic monohydroxymonocarboxylic acid having 9 to 32 carbon atoms in a chemical equivalent in terms of the primary amino group content of the polyalkylenepolyamine and the carboxyl group content of the latter, but some discrepancy from the chemical equivalent is allowable so long as a practical process is concerned. Typical examples of the polyalkylenepolyamine usable in the present invention include diethylenetriamine, triethylenetetramine, tetraethylenepentamine, pentaethylenehexamine, N,N-dimethylaminoethylendiamine and N,N-dimethylaminopropylenediamine.

According to the present invention, the aforementioned aliphatic monohydroxymonocarboxylic acid having 9 to 12 carbon atoms does not necessarily have to be used singly or as a pure substance, but it may be used in the form of a mixture such as fatty acids of lanolin or a mixture with one or more aliphatic monocarboxylic acids having 9 to 32 carbon atoms. The use of such a mixture may often be advantageous economically. In any case, however, such a mixture of carboxylic acids should contain at least 20% by weight or, preferably, at least 25% by weight of an aliphatic monohydroxymonocarboxylic acid having 9 to 32 carbon atoms. If a mixture of carboxylic acids having an aliphatic monohydroxymonocarboxylic acids content below 20% by weight is used to prepare the dispersing agent for an alkyl ketene dimer described previously, the resultant dispersion of the alkyl ketene dimer will have a significantly lower stability and become unable to contribute to the attainment of the object of the present invention any more. Typical examples of the aliphatic monocarboxylic acids having 9 to 32 carbon atoms that are usable as mixed with the aforementioned aliphatic monohydroxymonocarboxylic acids according to the present invention include capric acid (decanoic acid), lauric acid (dodecanoic acid), myristic acid (tetradecanoic acid), palmitic (hexadecanoic) acid, stearic (octadecanoic) acid, oleic acids, linoleic acid, linolenic acid, and fatty acids without hydroxyl groups contained in lanolin.

One of typically preferable examples of the aforementioned mixture of aliphatic carboxylic acids usable to provide the aliphatic monohydroxymonocarboxylic acid according to the present invention is the fatty acids mixture contained in lanolin. The fatty acids mixture of lanolin contains about 20–50% by weight of such aliphatic monohydroxymonocarboxylic acids having 9 to 32 carbon atoms and it can be used with a great economical advantage. Also, it has been experimentally shown that an aqueous dispersion of an alkyl ketene dimer obtained by useing such a fatty acids mixture of lanolin has a very high stability and that it can be applicable as a cellulose treating agent without any problems or difficulties.

In the present invention, the aforementioned monohydroxymonocarboxylic acids having 9 to 32 carbon atoms may be also used as mixtures thereof with aliphatic dicarboxylic acids having 4 to 40 carbon atoms. In this case, however, the content of such aliphatic dicarboxylic acids should be about 50% by weight or less. If the content of the aliphatic dicarboxylic acids exceeds 50% by weight, the resultant aqueous dispersion of an alkyl ketene dimer cannot have a sufficient stability and, thus, the aforementioned object of the present invention will not be achieved. If an minor amount of aliphatic dicarboxylic acids having 4 to 40 carbon atoms is mixed with the aliphatic monohydroxymonocarboxylic acids having 9 to 32 carbon atoms according to the present invention, it may sometimes produce more an advantageous effect on an aqueous dispersion of the resultant alkyl ketene dimer when the latter is used as a sizing agent for papermaking, in that the reduction in the strength of the product paper by the action of the alkyl ketene dimer can be suppressed thereby. Typical preferable examples of such aliphatic dicarboxylic acids having 4 to 40 carbon atoms include malonic acid, glutaric acid, adipic acid, azelaic acid, sebacic acid, maleic acid, fumaric acid, itaconic acid and dimer acid.

Further, according to the present invention, the aforementioned aliphatic monohydroxymonocarboxylic acids having 9 to 32 carbon atoms, aliphatic monocarboxylic acids having 9 to 32 carbon atoms and aliphatic dicarboxylic acids having 4 to 40 carbon atoms may be used a mixtures of these three types of carboxylic acids. Furthermore, besides these aliphatic carboxylic acids, other carboxylic acids such as aromatic carboxylic acids may be used in an amount not exceeding 20% by weight of the total content of the carboxylic acids, although the use of such other carboxylic acids is not particularly recommendable. If the content of such other carboxylic acids exceeds 20% by weight, the aforementioned object of the present invention will not be achieved.

All in all cases, however, the contents of the respective types of carboxylic acids to be used in the present invention should fall in the specific ranges formulated immediately hereinbelow per the total carboxylic acids content on account of the aforementioned reasons:

| | |
|---|---|
| Aliphatic monohydroxymonocarboxylic acid having 9 to 32 carbon atoms | 20 to 100% by weight |
| Aliphatic monocarboxylic acids having 9 to 32 carbon atoms | 0 to 80% by weight |
| Aliphatic dicarboxylic acids having 4 to 40 carbon atoms | 0 to 50% by weight |
| Other carboxylic acids | 0 to 20% by weight |

As to the content of a polyalkylenepolyamine to be reacted with the mixture of the carboxylic acids according to the present invention as described hereinabove, it is desired that they are used in a chemical equivalent in terms of the primary amino group content of the polyalkylenepolyamine and the carboxyl group content of the carboxylic acids mixture, but some discrepancy from the chemical equivalent is allowable so long as a practical process is concerned, as described herein previously. While, when reacted with the reaction product of these carboxylic acids and polyalkylenepolyamine, an epihalohydrin is effective to enhance the cationic properties of the resultant product. And aqueous dispersion of an alkyl ketene dimer obtained by using such a cationic reaction product as dispersing agent can be used as a dignificantly improved cellulose treating agent. Also, if this aqueous dispersion of an alkyl ketene dimer is used as a sizing agent for papermaking, the resultant paper can have an improved strength.

In the meantime, the reaction product of the carboxylic acids and polyalkylenepolyamine, namely, a polyamidepolyamine is dissolved in water in the form of positive ions of amine salts of inorganic or organic acids. Thus, if an epihalohydrin is reacted therewith, secondary and tertiary amino groups of the polyamidepolyamine will become tertiary amino groups and a quaternary ammonium salt, respectively, to show higher cationic properties. Although it is not necessary to specifically limit the amount of the dispersing agent to be mixed with an alkyl ketene dimer to disperse the same, it is generally suitable to mix 2 to 30 parts or, more specifically, 5 to 15 parts by weight of the dispersing agent with 100 parts by weight of the alkyl ketene dimer in terms of the solid contents thereof.

As fully described hereinbefore, the cellulose treating agent according to the present invention is very stable without undergoing a change in the stability over a long period of storage, and it has much an improved effect as compared with the prior art cellulose treating agent.

Especially, the cellulose treating agent according to the present invention is useful as a reactive sizing agent for papermaking. For example, the cellulose treating agent according to the present invention can be effectively applicable to those neutral papers for which a use of alum is restricted by some reasons or those papers using an alkaline loading materials such as calcium carbonate, which have so far been difficult to treat with ordinary rosin sizing agents. For papermaking, the cellulose treating agent of the present invention may be applicable effectively to both internal sizing and surface sizing. To size paper internally with the cellulose treating agent according to the present invention, a use of a water-soluble cationic polymer compound as an auxiliary sizing agent is effective to improve the sizing efficiency. While, for surface-sizing paper, the cellulose treating agent of the present invention may be used alone as a diluted dispersion in water, or it may be used as a mixture with starch-type agents, polyvinyl alcohol (PVA) or the like water-soluble polymers that are generally used for surface sizing.

As an auxiliary sizing agent for sizing paper internally with the aqueous dispersion of an alkyl ketene dimer according to the present invention, several well-known water-soluble cationic polymer compounds such as cationic starch and polyamide-epihalohydrin resins may be effectively used for the purpose of the present invention. However, a series of studies undertaken by the inventors has revealed that, for sizing paper internally with the cellulose treating agent according to the present invention, a cationically-modified polyacrylamine has an outstanding effect as an auxiliary sizing agent. For cationically modifying polyacrylamide, several methods are known in the art, and it has been experimentally shown that cationically-modified polyacrylamides obtained by any of those well-known method may be used as the auxiliary sizing agent with a remarkable effect. The cationically-modified polyacrylamide to be set forth herein later in the detailed description of the preferred examples is obtained by subjecting a polyacrylamide to Hofmann reaction in the presence of a stabilizing agent obtained by quaternary amination of a tertiary amine having a hydroxyl group with benzyl chloride or its derivatives, as disclosed in the Japanese Patent Application No. 54(1979)-15,915. Also, these cationically-modified polyacrylamides have an advantageous effect to improve remarkably the retention of an alkaline loading material such as calcium carbonate.

Hereinafter, the present invention will be described in greater detail by way of the preferred examples thereof.

DESCRIPTION OF THE PREFERRED EXAMPLES

Example 1

In a four-necked flask provided with a stirrer, thermometer and condenser, 60 g of hydroxystearic acid was placed and melted while passing nitrogen gas therethrough. Then, after adding 16 g of triethylenetetramine thereto, the content of the flask was subjected to reaction at 180°–185° C. for 6 hours. Subsequently, the reaction system was cooled to 100° C., and 14 g of glacial acetic acid was added thereto at that temperature, followed by dilution with warm water. These processes produced a dispersion having a solid content of 10% by weight. Hereinafter, this dispersion shall be referred to as the dispersing agent As according to the present invention.

Thereafter, 10 parts by weight, as solid content, of the dispersing agent As was added to 90 parts by weight of hexadecyl ketene dimer having the following structural formula:

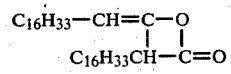

To this mixture, warm water was added under agitation until 1000 parts by weight in total of a dispersion was obtained. Then, this dispersion was further homogenized by means of a homogenizer. Hereinafter, the resultant dispersion, having a solid content of 10% by weight, shall be referred to as the cellulose treating agent A according to the present invention.

Example 2

To the dispersing agent As prepared by repeating the same processes as those of the preceding Example 1, 20 g of epichlorohydrin was added, and the system was subjected to a reaction at 80°–85° C. for 2 hours. This reaction produced a dispersion having a solid content of 10% by weight. Hereinafter, this dispersion shall be referred to as the dispersing agents Bs according to the present invention.

Thereafter, by using 10 parts by weight, as solid content, or the dispersing agent Bs, a dispersion of hexadecyl ketene dimer was prepared in the same manner as in the preceding Example 1. Hereinafter, this dispersion shall be referred to as the cellulose treating agent B according to the present invention.

Example 3

In a four-necked flask provided identically to that used in the foregoing Example 1, 60 g of hydroxystearic acid, 29.2 g of adipic acid and 48 g of triethylenetetramine were placed and subjected to a reaction under the same conditions as those in Example 1. At the end of the reaction, 70 g of 1/10 N aqueous solution of hydrochloric acid was added thereto. Then, after diluting with warm water, 11 g of epichlorohydrin was added thereto, and the resultant reaction system was subjected to a reaction at 80°–85° C. for 2 hours. This reaction produced a dispersion having a solid content of 20% by weight. In this case, this dispersion was present as a mixture of a reaction product of the foregoing carboxylic acids with triethylenetetramine and a product obtained by a reacting epichlorohydrin with said reaction product. Hereinafter, this dispersion shall be referred to as the dispersing agent Cs according to the present invention.

Thereafter, by using 10 parts by weight, as solid content, of the dispersing agent Cs, a dispersion of hexadecyl ketene dimer was prepared in the same manner as in the preceding Example 2. Hereinafter, this dispersion shall be referred to as the cellulose treating agent C according to the present invention.

Example 4

In a four-necked flask provided identically to that used in the foregoing Example 1, 100 g of refined lanolin fatty acid was melted. After adding 18.7 g of triethlenetetramine thereto, the content of the flask was subjected to a reaction at 180°-185° C. for 6 hours. Then, the reaction system was cooled to 100° C., and 18 g of glacial acetic acid was added at that temperature, followed by dilution with warm water. These processes produced a dispersion having a solid content of 11.5% by weight. Hereinafter, this dispersion shall be referred to as the dispersing agent Ds according to the present invention.

Thereafter, by using 10 parts by weight, as solid content, of the dispersing agent Ds, a dispersion of hexadecyl ketene dimer was prepared in the same manner as in the preceding Example 3. Hereinafter, this dispersion shall be referred to as the cellulose treating agent D according to the present invention.

Example 5

To 100 g of the dispersion Ds obtained in the preceding Example 4, 2.4 g of epichlorohydrin was added, and the resultant system was subjected to a reaction at 80°-85° C. for 2 hours to produce a dispersion having a solid content of 13.5% by weight. Hereinafter, this dispersion shall be referred to as the dispersing agent Es according to the present invention.

Thereafter, by using 10 parts by weight, as solid content, of the dispersing agent Es, a dispersion of hexadecyl ketene dimer was prepared in the same manner as in the preceding Example 4. Hereinafter, this dispersion shall be referred to as the cellulose treating agent E according to the present invention.

Example 6

Except that 58 g of dimer acid (Versadime 216 supplied by Henkel Japan Limited), 82 g of refined lanolin fatty acid and 34 g of diethylenetriamine were used, the same procedures and conditions as those of the foregoing Example 4 were repeated to subject the input materials to a reaction. At the end of the reaction, 30 g of 1/10 N aqueous solution of hydrochloric acid was added thereto, followed by dilution with warm water. Then, after adding 36 g of epichlorohydrin thereto, the resultant system was subjected to a reaction at 80°-85° C. for 2 hours to produce a dispersion having a solid content of 15% by weight. Hereinafter, this dispersion shall be referred to as the dispersing agent Fs according to the present invention.

Thereafter, by using 10 parts by weight, as solid content, of the dispersing agent Fs, a dispersion of hexadecyl ketene dimer was prepared in the same manner as in the preceding Example 5. Hereinafter, this dispersion shall be referred to as the cellulose treating agent F according to the present invention.

Example 7

Except that 29 g of adipic acid, 82 g of refined lanolin fatty acid and 48 g of triethylenetetramine were used, the same procedures and conditions as those of the foregoing Example 4 were repeated to subject the input material to a reaction. At the end of the reaction, 71 g of 1/10 N aqueous solution of hydrochloric acid was added thereto, and the resultant system was diluted with warm water to produce a dispersion having a solid content of 20% by weight. Hereinafter, ths dispersion shall be referred to as the dispersing agent Gs according to the present invention.

Thereafter, by using 10 parts by weight, as solid content, of the dispersing agent Gs, a dispersion of hexadecyl ketene dimer was prepared in the same manner as in the preceding Example 6. Hereinafter, this dispersion shall be referred to as the cellulose treating agent G according to the present invention.

Example 8

Except that 60.5 g of castor oil fatty acid, 20.2 g of sebacic acid and 48.7 g of pentaethylenehexamine were used instead of hydroxystearic acid and triethylenetetramine, the same procedures and conditions as those used in the foregoing Example 1 were repeated to subject the input materials to a reaction. At the end of the reaction, 54 g of glacial acetic acid was added thereto, followed by dilution with warm water. Then, after adding 7.4 g of epichlorohydrin thereto, the resultant system was subjected to a reaction at 80°-85° C. for 2 hours to produce a dispersion having a solid content of 20% by weight. Hereinafter, this dispersion shall be referred to as the dispersing agent Hs according to the present invention. Thereafter, by using 10 parts by weight, as solid content, of the dispersing agent Hs, a dispersion of hexadecyl ketene dimer was prepared in the same manner as in the preceding Example 7. Hereinafter, this dispersion shall be referred to as the cellulose treating agent H according to the present invention.

Example 9

Except that 90.8 g of castor oil fatty acid, 80.8 g of sebacic acid, 28.3 g of oleic acid and 153.1 g of pentaethylenehexamine were used instead of hydroxystearic acid and triethylenetetramine, the same procedures and conditions as those of the foregoing Example 1 were repeated to subject the input materials to a reaction. At the end of the reaction, 165 g of glacial acetic acid was added thereto. Then, the resultant system was diluted with warm water to obtain a dispersion having a solid content of 20% by weight. Hereinafter, this dispersion shall be referred to as the dispersing agent Is according to the present invention.

Thereafter, by using 10 parts by weight, as solid content, of the dispersing agent Is, a dispersion of hexadecyl ketene dimer was prepared in the same manner as the preceding Example 8. Hereinafter, this dispersion shall be referred to as the cellulose treating agent I according to the present invention.

The lanolin fatty acid used in the foregoing Example 4 through 7 had the following composition (in terms of percent by weight):

| | |
|---|---|
| Normal fatty acids with $C_{10-32}$ ($CH_3.CH_2CH_2...CH_2COOH$) | 7% |
| Iso-fatty acids with $C_{10-32}$ ($(CH_3)_2CHCH_2...CH_2COOH$) | 23% |
| Anteiso-fatty acids with $C_{9-31}$ ($CH_3CH_2-CH(CH_3)CH_2...CH_2COOH$) | 30% |
| Hydroxy fatty acids with $C_{9-32}$ ($CH_3CH_2...CH(OH)COOH$) | 35% |

-continued

| | |
|---|---|
| Other fatty acids | 5% |

The aforementioned cellulose treating agents A through I according to the present invention all showed a high dispersion stability, and no coarse particles were deposited when they were subjected to 30 days of shelf test.

Reference 1

By using 56.8 g of stearic acid and 16 g of triethylenetetramine, the same procedures and conditions as those of the foregoing Example 1 were repeated to subject the input materials to a reaction. At the end of the reaction, 16 g of glacial acetic acid and warm water were added to the reaction product to disperse the same. Then, after adding 20 g of epichlorohydrin thereto, the resultant system was subjected to a reaction at 80°-85° C. for 2 hours to produce a dispersion having a solid content of 15% by weight. Hereinafter, this dispersion shall be referred to as the dispersing agent Js.

By using the dispersing agent Js, a cellulose treating agent comprising a dispersion of hexadecyl ketene dimer was prepared in the same manner as in the foregoing Examples 1 through 9. When this cellulose processing agent was left to stand for 24 hours, a large amount of coarse particles were deposited therefrom.

Reference 2

By using cationic starch (CATO-F produced by Oji National Co., Ltd.) as a dispersing agent, a cellulose treating agent was prepared in the same manner as in the foregoing Examples 1 through 9. When this cellulose treating agent was left to stand for 24 hours, a large amount of coarse particles were deposited therefrom.

Reference 3

By using a polyamidepolyamine-epichlorohydrin resin (Kymeme 557H produced by Dic Hercules Co., Ltd.) as a dispersing agent, a cellulose treating agent was prepared in the same manner as in the foregoing Examples 1 through 9. When this cellulose treating agent was left to stand for 24 hours, a large amount of coarse particles were deposited therefrom.

Examples 1a through 9a

Paper was manually made from raw pulp L-BKP (with Canadian Standard freeness of 400 cc), calcium carbonate (30 parts by weight per 100 parts by weight of the pulp as air-dried) as the loading material and a neutral sizing agent for papermaking (Pearl Gum CS produced by Seiko Chemical Industry Limited, 0.1 part by weight per 100 parts by weight of the pulp as air-dried). The handmade paper had about a weight of 60 g/m$^2$.

A dilute solution containing 0.2% by weight, as solid, of each of the foregoing cellulose treating agents A through I according to the present invention was coated on the surface of the handmade paper by means of a testing roll coater, and the thus coated paper was heated and dried in a rotary dryer (at 80° C. for 200 seconds) to obtain surface-sized paper. The resultant sized-paper was subjected to a test according to JIS P-8122 for measuring its Stökigt sizing degree, the results of which are summarized in Table 1. As a control of the cellulose treating agent, for this test, commercially available Hercon 40 (papermaking sizing agent of alkyl ketene dimer type produced by Dick Hercules Co., Ltd.) was used.

TABLE 1

| Examples | Cellulose processing agents | Quantity of cellulose processing agent absorbed by surface-sized paper (wt. % of solid content based on surface-sized paper) | Stokigt sizing degree |
|---|---|---|---|
| | None | — | 0 |
| 1a | A | 0.24 | 28 |
| 2a | B | 0.23 | 32 |
| 3a | C | 0.25 | 35 |
| 4a | D | 0.23 | 27 |
| 5a | E | 0.25 | 34 |
| 6a | F | 0.26 | 33 |
| 7a | G | 0.27 | 29 |
| 8a | H | 0.24 | 31 |
| 9a | I | 0.26 | 30 |
| | Control | 0.27 | 22 |

Example 1b through 9b

To a mixture of 100 parts by weight of a pulp slurry (L-BKP with Canadian Standard freeness of 400 cc) and 30 parts by weight (as air-dried) of calcium carbonate as the loading material, 0.5 part by weight, as solid, of each of the foregoing cellulose treating agents A through I according to the present invention was added to manually make internally-sized paper by a well-known method in the art by using a manual papermaking machine (TAPPI Standard Sheet Machine manufactured by Toyo Seiki Co., Ltd., Japan). The resultant handmade paper had a weight of about 60 g/m$^2$ and subjected to a test to measure its Stoökigt sizing degree and burst strength, the results of which are summarized in Table 2.

TABLE 2

| Example | Cellulose processing agents | Stokigt sizing degree (sec.) | Burst strength (Kg/cm$^2$) |
|---|---|---|---|
| 1b | A | 9 | 1.05 |
| 2b | B | 18 | 1.07 |
| 3b | C | 21 | 1.09 |
| 4b | D | 10 | 1.03 |
| 5b | E | 20 | 1.06 |
| 6b | F | 20 | 1.12 |
| 7b | G | 9 | 1.11 |
| 8b | H | 19 | 1.08 |
| 9b | I | 13 | 1.02 |
| | Control | 0 | 1.04 |

As the control of the cellulose treating agent, the same agent as that used in Examples 1a through 9a was used.

Examples 1c through 9c

Except that 0.05 parts by weight, as solid, of a polyamidepolyamine-epichlorohydrin resin water-soluble cationic polymer (Kymeme 557H produced by Dic Hercules Co., Ltd.) was added as an auxiliary sizing agent, the same procedures and conditions were repeated to prepare handmade paper. Each resultant handmade paper had a weight of about 60 g/m$^2$ and subjected to a test to measure its Stökigt sizing degree and burst strength, the results of which are summarized in Table 3.

TABLE 3

| Examples | Cellulose processing agents | Stokigt sizing degree (sec.) | Burst strength (Kg/cm$^2$) |
|---|---|---|---|
| 1c | A | 21 | 1.04 |
| 2c | B | 30 | 1.08 |
| 3c | C | 34 | 1.10 |
| 4c | D | 21 | 1.02 |
| 5c | E | 31 | 1.06 |
| 6c | F | 32 | 1.13 |
| 7c | G | 22 | 1.10 |
| 8c | H | 33 | 1.09 |
| 9c | I | 26 | 1.07 |
| | Control | 14 | 1.02 |

As the control of the cellulose treating agent, the same agent as that used in Examples 1a through 9a was used.

Example 1d through 9d

To 190 g of an aqueous solution containing 8.5% by weight of polyacrylamide with an average molecular weight of about 300,000, added was 1.5 g of a stabilizer (dimethylethanolamine as converted into quaternary ammonium salt with banzil chloride). Then, 97.7 g of an alkaline aqueous solution of sodium hypochlorite (containing 30 g of sodium hypochlorite and 2.8 g of sodium hydroxide) was slowly added to the resultant mixture solution under cooling and agitation. The resultant reaction system was held at 25° C. for 60 minutes to subject the polyacrylamide to Hofmann reaction. At the end of the reaction, dilute hydrochloric acid was thereto to adjust the hydrogen ion concentration to pH4.5 to obtain an auxiliary sizing agent.

Except that the thus obtained auxiliary sizing agent was used instead of the polyamidepolyamine-epichlorohydrin resin was used, the same procedures and conditions as those used in the foregoing Examples 1c through 9c were repeated to prepare handmade paper. Each resultant handmade paper having a weight of about 60 g/m$^2$ was subjected to a test to measure its Stökigt sizing degree and burst strength, the results of which are summarized in Table 4.

TABLE 4

| Examples | Cellulose processing agent | Stokigt sizing degree (sec.) | Burst strength (Kg/cm$^2$) |
|---|---|---|---|
| 1d | A | 30 | 0.96 |
| 2d | B | 37 | 0.98 |
| 3d | C | 39 | 1.00 |
| 4d | D | 29 | 0.94 |
| 5d | E | 40 | 0.95 |
| 6d | F | 40 | 1.09 |

TABLE 4-continued

| Examples | Cellulose processing agent | Stokigt sizing degree (sec.) | Burst strength (Kg/cm$^2$) |
|---|---|---|---|
| 7d | G | 31 | 1.03 |
| 8d | H | 42 | 1.06 |
| 9d | I | 37 | 1.0 |

FEASIBILITY AND APPLICABILITY IN THE INDUSTRY

As fully understood hereinbefore, the cellulose treating agent of the present invention comprising a very stable cationic aqueous dispersion of an alkyl ketene dimer is highly effective to impart a water repellency to paper and other cellulosic products and, especially, can provide much an improved sizing agent for papermaking. Thus, it will be obvious that the cellulose treating agent of the present invention can make a great contribution to the industry.

What is claimed is:

1. A cellulose treating agent obtained by dispersing an alkyl ketene dimer in water in the presence of a dispersing agent, said dispersing agent comprising: (a) reaction product of a polyalkylenepolyamine and a mixture of carboxylic acids containing at least 20% by weight of aliphatic monohydroxymonocarboxylic acids having 9 to 32 carbon atoms: or (b) a product obtained by reacting epihalohydrin with said reaction product.

2. The cellulose treating agent according to the preceding to claim 1, wherein said mixture of carboxylic acids contains 20 to 100% by weight of aliphatic monohydroxymonocarboxylic acid having 9 to 32 carbon atoms, 0 to 50% by carbon atoms, 0 to 80% by weight of aliphatic monocarboxylic acids having 9 to 32 carbon atoms and/or a minor amount of carboxylic acids other than those cited above.

3. The cellulose treating agent according to the foregoing claim 1 or 2, wherein said mixture of carboxylic acids is mainly composed of fatty acids of lanolin.

4. Paper sized with a cellulose treating agent which is obtained by dispersing an alkyl ketene dimer in the presence of a dispersing agent, said dispersing agent comprising: (a) a reaction product of a polyalkylenepolyamine and a mixture of carboxylic acids containing at least 20% by weight of aliphatic monohydroxymonocarboxylic acids having 9 to 32 carbon atoms and 0 to 50% by weight of aliphatic dicarboxylic acids having 4 to 40 carbon atoms or; (b) a product obtained by reacting epihalohydrin with said reaction product.

5. The paper according to the preceding claim 4, wherein said paper is internally sized with said cellulose treating agent in the presence of a water-soluble cationic polymer.

6. The paper according to the preceding claim 5, wherein said water-soluble cationic polymer comprises a cationically-modified polyacrylamide.

* * * * *